US009574765B2

(12) United States Patent
Aho

(10) Patent No.: US 9,574,765 B2
(45) Date of Patent: Feb. 21, 2017

(54) GENERATION OF STEAM BY IMPACT HEATING

(76) Inventor: Richard E. Aho, Lauderdale Lakes, FL (US)

( * ) Notice: Subject to any disclaimer, the term of this patent is extended or adjusted under 35 U.S.C. 154(b) by 1064 days.

(21) Appl. No.: 13/324,353

(22) Filed: Dec. 13, 2011

(65) Prior Publication Data

US 2013/0145997 A1 Jun. 13, 2013

(51) Int. Cl.
*F22B 27/00* (2006.01)
*F22B 27/16* (2006.01)
*F22G 1/10* (2006.01)

(52) U.S. Cl.
CPC ..... *F22B 27/16* (2013.01); *F22G 1/10* (2013.01)

(58) Field of Classification Search
CPC ..... F22B 27/00; F22B 27/16; F22G 1/10
USPC ..... 122/40; 60/227, 642, 670; 123/25 C
See application file for complete search history.

(56) References Cited

U.S. PATENT DOCUMENTS 4,322,950 A * 4/1982 Jepsen ..... 60/712
4,603,554 A 8/1986 Lagow
4,706,462 A * 11/1987 Soltermack ..... 60/712
2002/0162518 A1 11/2002 Dumaz et al.
2003/0062004 A1 4/2003 Hays et al.
2004/0069245 A1 4/2004 Griffin et al.
2004/0089486 A1 5/2004 Harrup et al.
2004/0261416 A1* 12/2004 White ..... 60/653
2007/0175218 A1 8/2007 Harrison, Sr.
2008/0202454 A1* 8/2008 Pirault ..... 123/58.8
2009/0100832 A1* 4/2009 Loeffler ..... F22B 27/16 60/512
2009/0107144 A1 4/2009 Moghtaderi et al.
2010/0230831 A1 9/2010 Rasmussen et al.
2010/0293949 A1* 11/2010 Aho ..... F01K 15/02 60/670

OTHER PUBLICATIONS

STIC Search Report.*
T. Raz et al, "On the Shattering of Clusters by Surface Impact Heating," The Fritz Haber Research Center for Molecular Dynamics, The Hebrew University, Jerusalem 91904, Israel, pp. 8097-8102, Received Jul. 1996, Accepted Aug. 1996.
Johnson, C., Physics in an Automotive Engine; Abstract from C. Johnson Physicist; First placed on the Internet Feb. 2003; (4 pages).
Graneau, et al., Arc-liberated Chemical Energy Exceeds Electrical Input Energy; 2000 Cambridge University Press, Peter Graneau, Neal Graneu, George Hathaway and Richard L. Hull; (14 pages).
(Continued)

*Primary Examiner* — Alissa Tompkins
*Assistant Examiner* — Nathaniel Herzfeld
(74) *Attorney, Agent, or Firm* — Luedeka Neely Group, PC

(57) ABSTRACT

Apparatus for generating steam, the apparatus including a source of liquid water, an injector in flow communication with the source of water for injecting liquid water from the source of water at a pressure of at least about 10,000 psia, and an impact chamber having a contact surface onto which the injected water is contacted. upon impact of the injected water with the contact surface of the impact chamber, the injected water undergoes a virtually instantaneous phase transition from the liquid state to a gaseous state following the contact of the water with the contact surface, thereby generating steam.

10 Claims, 3 Drawing Sheets

(56) References Cited

OTHER PUBLICATIONS

Raz, T. et al., "On the Shattering of Clusters by Surface Impact", R. Camparague Ed. Springer, Berlin 2001, pp. 849-872.
Kinsey, J.L. et al., "Energy and Chemical Change", Final Technical Report; Rice University, Houston, Texas; Dec. 2001.
Hong-Hui et al., "The Measurement of Impact Pressure and Solid Surface Response in Liquid-Solid Impact Up to Hypersonic Range", Tohuku University, Katahira, Japan 1995.
PCT/US12/55283 International Search Report and Written Opinion, dated Dec. 7, 2012, (11 pages).
C. Johnson, Theoretical Physicist, Physics Degree From University of Chicago Automotive Engine—Physics and Mechanics—First Placed on the Internet Feb. 2003.

* cited by examiner

GENERATION OF STEAM BY IMPACT HEATING

FIELD

The present disclosure relates to steam generation. More particularly, the disclosure relates to methods and apparatus for generating steam by injecting small amounts of water at high speed into an impact chamber.

BACKGROUND

Conventional attempts to heat water to provide steam require substantial heat and energy requirements, especially for the production of superheated steam. For example, superheated steam boilers typically further heat steam that has already been vaporized from water. High temperature steam is essential for use in modern power generation and other steam driven applications. The process of heating steam in superheat boilers is an energy intensive thermodynamic process heavily dependent on fossil fuel. Given the background scenario of diminishing energy supplies and environmental air quality considerations, more energy efficient steam generation processes are desired.

In accordance with the present disclosure, steam, including superheated steam, may be produced in a process by which liquid water is substantially instantaneously converted to a gas state using apparatus configured to transform multiple, sequential injections of water into gas. It has been discovered that steam and superheated steam can be generated using the apparatus, with much lower heat and energy requirements as compared to conventional methods and apparatus.

SUMMARY

The above and other needs are met by an apparatus for generating steam. In one aspect, the apparatus includes a source of liquid water, an injector in flow communication with the source of water for injecting liquid water from the source of water at a pressure of at least about 10,000 psia, and an impact chamber having a contact surface onto which the injected water is contacted.

Upon impact of the injected water with the contact surface of the impact chamber, the injected water undergoes a virtually instantaneous phase transition from the liquid state to a gaseous state following the contact of the water with the contact surface, thereby generating steam. In an alternative embodiment, superheated steam is produced.

In yet another aspect of the disclosure, there is provide a method for generating steam. The method includes the steps of providing a source of liquid water; providing an injector in flow communication with the source of water; providing an impact chamber having a contact surface; and using the injector to inject liquid water from the source of water at a pressure of at least about 10,000 psia into the impact chamber for contact with the contact surface.

Upon impact of the injected water with the contact surface of the impact chamber, the injected water undergoes a virtually instantaneous phase transition from the liquid state to a gaseous state following the contact of the water with the contact surface, thereby generating steam.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
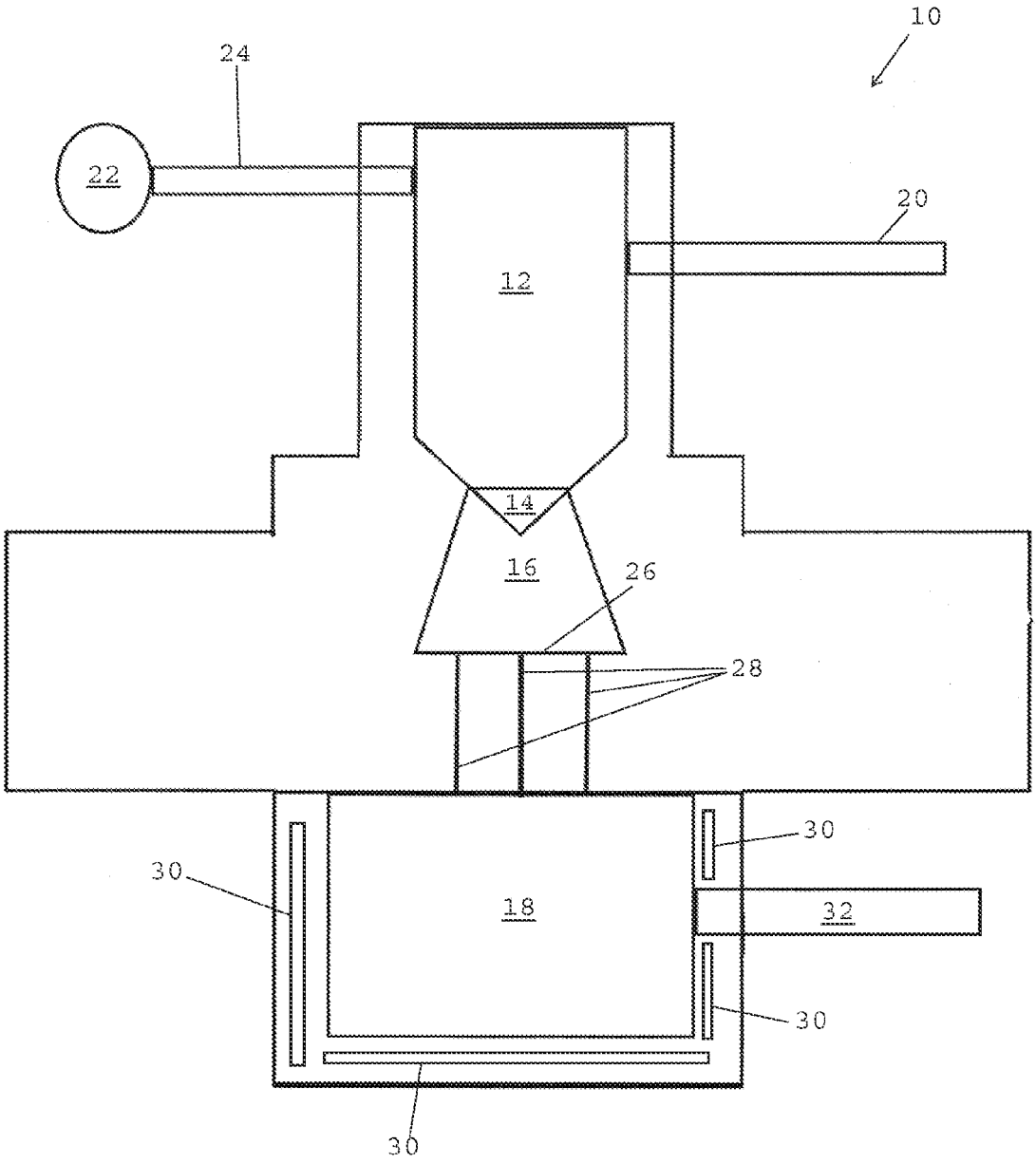
FIG. 1 is a schematic view of apparatus for generating steam according to one embodiment of the disclosure.

With initial reference to FIG. 1, the disclosure relates in one aspect to a steam generation apparatus 10 configured to act upon introduced water so that the water undergoes a virtually instantaneous phase transition from the liquid state to the gaseous state following the collision of an atomized water jet with a hard surface, thereby generating steam. The gas is thereafter expanded and maintained at a temperature of at least about 299° F., and may be routed thereafter for use. For example, the steam may be used for cleaning purposes, to run a turbine for generating electricity, and for various uses for which steam is typically used.

It has been discovered that the apparatus is able to generate steam, as well as superheated steam, using substantially less energy than is conventionally required to generate steam and superheated steam.

The apparatus 10 includes, as major components, an injector 12 having an atomizer 14, an impact chamber 16, and an expansion chamber 18.

The injector 12 is configured to introduce discrete pulses of water, each pulse having a volume of from about 0.1 to about 0.5 ml, at a pressure of from about 10,000 psia to about 29,000 psia, to inject the water at a speed in the hypersonic speed range, of between about 1,710 m/s and 3,415 m/s. The injector 12 is computer controlled to continuously inject the discrete injections of water to continuously generate steam.

The water is introduced via a supply line 20 and the water can be at any temperature that the water is in the liquid state at the introduced pressure. For example, the injector 12 may be a hydraulic pressure fuel injector, having a pump 22 for pressuring oil within a conduit 24. The atomizer 14 is configured to provide the desired volume pulses of water at the desired pressure, to yield the desired velocity. The atomizer 14 may have multiple orifices, with the diameter of each orifice ranging from about 0.005 inches to about 0.010 inches. For example, the atomizer 14 may have seven orifices, with each orifice having a diameter of 0.007 inches. By injecting the desired volume of water at a desired hypersonic speed, it has been discovered that steam and superheated steam may be generated with low energy input. In this regard, higher injection velocities result in higher temperatures within the impact chamber 16.

The impact chamber 16 is located to receive water ejected from the injector 12 via the atomizer 14 and is configured to expand in dimension away from the atomizer 14, and is preferably configured as an inverted funnel. The impact chamber 16 preferably has a volume of from about 2 ml to about 10 ml. The chamber 16 includes an impact surface 26 onto which the atomized water jet from the atomizer 14 collides. It has been discovered that by injecting pulses of water as described, the water undergoes a virtually instantaneous phase transition from the liquid state to the gaseous state following the collision of the atomized water jet with the surface 26. The impact chamber 16 is made of stainless steel, with the impact surface 26 preferably being polished. The perimeter of the impact surface 26 is advantageously insulated. However, it has been observed that it is not necessary to provide auxiliary heating to the impact chamber 16, as the continuous generation of steam results in maintenance of the impact chamber 16 at high temperatures associated with steam.

The expansion chamber 18 is positioned to receive the steam generated within the impact chamber 16, and to route it for subsequent use. The steam is routed to the expansion chamber 18 as by one or more conduits or ports 28 that extend between the impact chamber 16 and the expansion chamber 18. The expansion chamber 18 includes one or more heaters 30, such as electric heaters, to maintain the expansion chamber 18 at a temperature of from about 299° F. to about 1200° F. so as to maintain the steam therein at the desired state, with the expansion chamber 18 also preferably being insulated to reduce heat losses. The steam may be routed from the expansion chamber 18 for use as by use of a conduit 32. The expansion chamber 18 has a volume larger than the impact chamber 16, preferably from about 20 to about 40 ml.

In this regard, it has been observed that the temperature generated from impacting water in the impact chamber 16 as described yields a temperature within the impact chamber 16 of at least about 800° F., such that superheated steam is generated. In this regards, temperatures of about 2,000° F. have been observed in the impact chamber 16. However, if non-superheated steam is the desired end product to be provided from the expansion chamber 18, then it is only necessary to maintain the expansion chamber 18 at a temperature of about 299° F. However, if superheated steam is desired to be obtained from the expansion chamber 18, then the expansion chamber 18 should be maintained at higher temperatures, such as above about 800° F.

Figure 2:
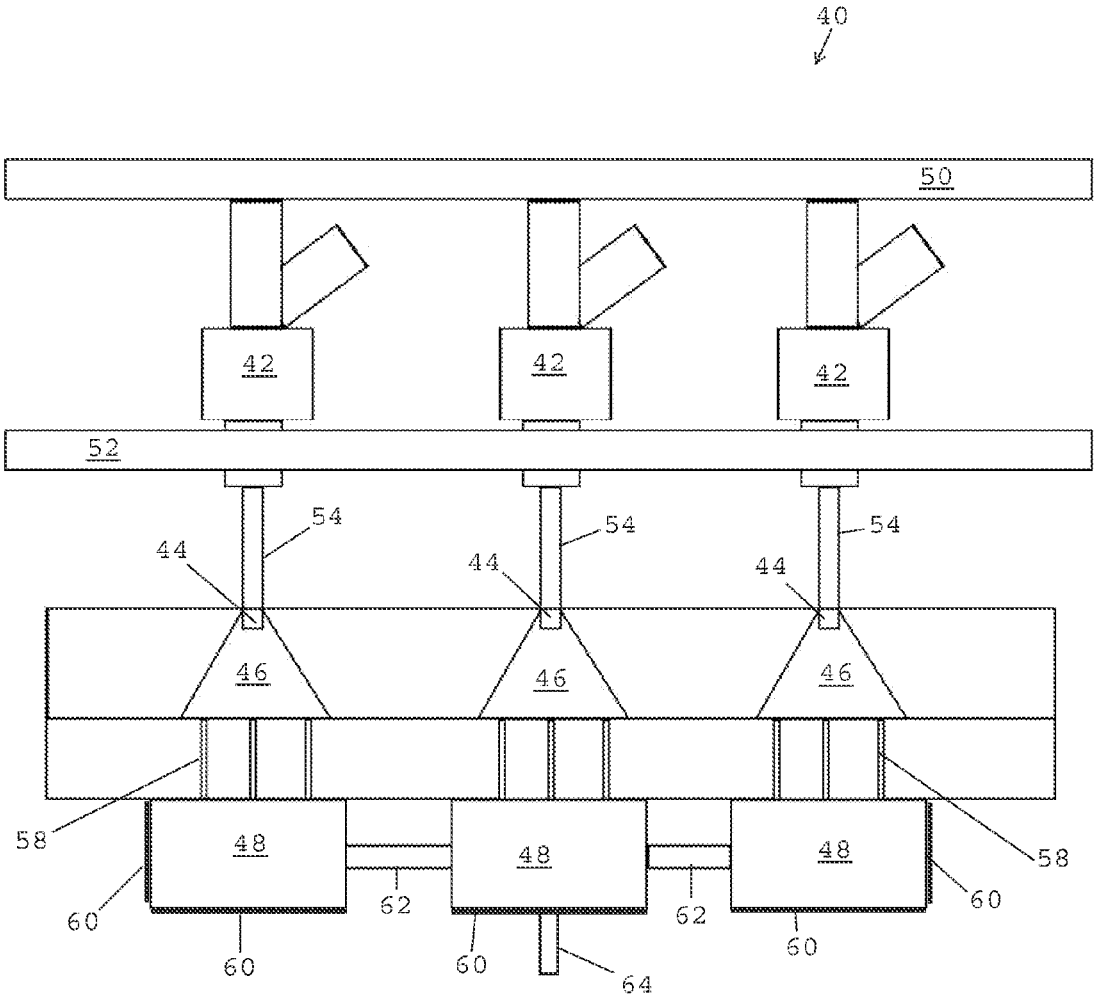
FIG. 2 is a schematic view of apparatus for generating steam according to another embodiment of the disclosure.

In accordance with another embodiment, and with reference to FIG. 2, there is shown an apparatus 40 for generating superheated steam. The apparatus 40 has multiple injectors 42, each of the injectors 42 having an associated atomizer 44, an impact chamber 46, and an expansion chamber 48. The injectors 42 are preferably piezoelectric injectors. The atomizers 44, impact chambers 46, and the expansion chambers 48 preferably substantially correspond to the previously described atomizer 14, impact chamber 46, and expansion chamber 18. Water is introduced to the injectors 42 as by a supply conduit 50. A stabilizer mount 52 may be provided to position the injectors 42. Also, as piezoelectric injectors may be disadvantageously affected by the heat of the superheated steam generated by the apparatus 40, the atomizers 44 and the associated impact chambers 46 are preferably spaced from the injectors 42 as by conduits 54. The steam is routed to the expansion chambers 48 as by conduits or ports 58 that extend between the impact chambers 46 and the expansion chambers 48. The expansion chambers 48 include heaters 60, such as electric heaters, to maintain the expansion chambers 48 at a temperature of about 299° F. to about 1200° F. so as to maintain the steam therein at the desired state. The expansion chambers 48 may be interconnected as by conduits 62, it being understood that one or more flow paths, such as conduit 64, may be provided to route the steam from the expansion chambers 48 for use.

Figure 3:
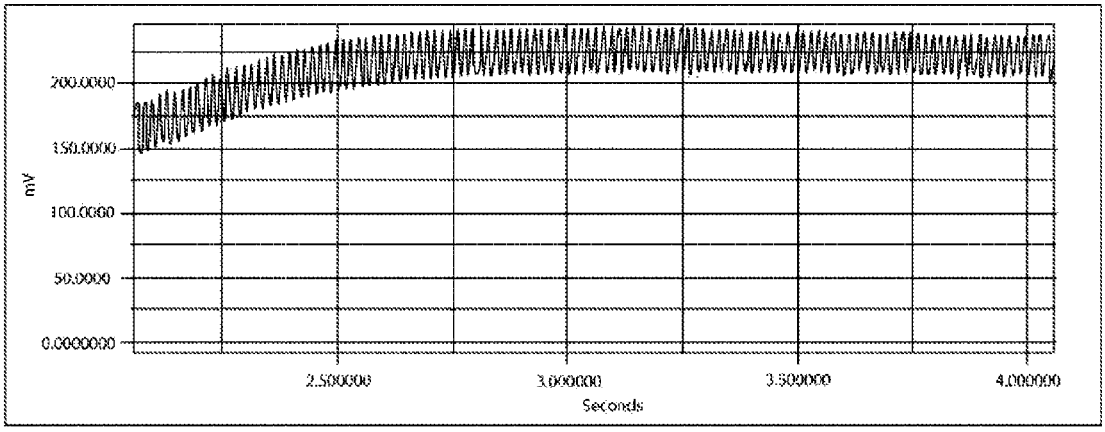
FIG. 3 is a graph showing pressure as a function of time for operation of the apparatus of FIG. 1 to generate steam.

With reference to FIG. 3, there is shown a graph of pressure as a function of time for a test operation of the apparatus of FIG. 1 to generate steam. The atomizer 14 had seven orifices, with each orifice having a diameter of 0.007 inches. The injector 12 was operated to supply 10 pulses of 0.3 ml of water each, one after the other into the impact chamber 16, at a pressure of 15,000 psia. Each pulse required 8 milliseconds. The expansion chamber 18 was equipped with a strain gauge operational to 425° F., with 1 mv on the gauge equal to 4 psia of pressure.

In conducting the test operation, the water introduced into the injector 12 was maintained at a temperature of from about 190° F. to about 210° F. However, it has been subsequently discovered that the water does not need to be heated and may be provided at lower temperatures. In addition, in conducting the test operation, the impact chamber 16 was initially heated to a temperature of 405° F., however, it has been subsequently discovered that it is not necessary to supply any initial heating to the impact chamber 16, but that it is advantageous to provide heating to the expansion chamber 18 to maintain the steam routed thereto at the desired state.

With reference to the graph of FIG. 3, it will be seen that after the injections the strain gauge had a reading of 225 millivolts, which corresponds to approximately 900 psia, it being understood that water in an environment of 900 psia corresponds to steam at a temperature of 531.98° F. Accordingly, it has been discovered that steam can be very quickly produced. Furthermore, such steam may be maintained at the desired temperature, provided it is contained in an adiabatic vessel.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed:

1. Apparatus for generating steam, comprising:

a source of liquid water;

an injector in flow communication with the source of water for injecting liquid water from the source of water at a pressure of at least about 10,000 psia and a hypersonic velocity of at least about 1710 meters per second; and an unheated impact chamber having an unheated contact surface onto which the injected water is contacted, the impact chamber configured as an inverted funnel, with a smallest dimension of the funnel shape being adjacent the injector and the largest dimension of the funnel shape being spaced from the injector and providing the contact surface;

wherein, upon impact of the injected water with the contact surface of the impact chamber, the injected water undergoes an instantaneous phase transition from the liquid state to a gaseous state following the contact of the water with the contact surface, thereby generating steam.

2. The apparatus of claim 1, further comprising an expansion chamber in communication with the impact chamber and maintained at a temperature of at least about 299° F. for receiving steam from the impact chamber and maintaining the steam as superheated steam.

3. The apparatus of claim 1, wherein the injector includes an atomizer for atomizing the injected water.

4. The apparatus of claim 1, wherein the injector injects a plurality of pulses of water, each of the pulses having a volume of from about 0.1 ml to about 0.5 ml.

5. The apparatus of claim 1, wherein the water is injected at a pressure of above about 10,000 psia.

6. The apparatus of claim 1, wherein the steam is superheated steam.

7. A method for generating steam, comprising the steps of:

providing a source of liquid water;

providing an injector in flow communication with the source of water;

providing an unheated impact chamber having an unheated contact surface;

using the injector to inject liquid water from the source of water at a pressure of at least about 10,000 psia and a hypersonic velocity of at least about 1710 meters per second into the impact chamber for contact with the contact surface;

wherein, upon impact of the injected water with the contact surface of the impact chamber, the injected water undergoes an instantaneous phase transition from the liquid state to a gaseous state following the contact of the water with the contact surface, thereby generating steam.

8. The method of claim 7, further comprising the steps of providing an expansion chamber in communication with the impact chamber and maintaining the expansion chamber at a temperature of at least about 299° F., and communicating steam from the impact chamber to maintain a supply of steam.

9. The method of claim 7, wherein the step of injecting the water comprises sequentially injecting a plurality of pulses of water, each of the pulses having a volume of from about 0.1 ml to about 0.5 ml.

10. The method of claim 7, wherein the steam generated is superheated steam.

* * * * *